US007757468B2

(12) United States Patent
Kastner

(10) Patent No.: US 7,757,468 B2
(45) Date of Patent: Jul. 20, 2010

(54) DEVICE FOR STRAPPING PACKAGES WITH STRAPPING MATERIAL

(75) Inventor: Hans Gunter Kastner, Wulfrath (DE)

(73) Assignee: Illinois Tool Works Inc., Glenview, IL (US)

( * ) Notice: Subject to any disclaimer, the term of this patent is extended or adjusted under 35 U.S.C. 154(b) by 91 days.

(21) Appl. No.: 12/093,088

(22) PCT Filed: Nov. 10, 2006

(86) PCT No.: PCT/IB2006/003172

§ 371 (c)(1),
(2), (4) Date: May 8, 2008

(87) PCT Pub. No.: WO2007/054801

PCT Pub. Date: May 18, 2007

(65) Prior Publication Data

US 2008/0276578 A1 Nov. 13, 2008

(30) Foreign Application Priority Data

Nov. 14, 2005 (DE) ..... 10 2005 054 529

(51) Int. Cl.
*B65B 13/06* (2006.01)

(52) U.S. Cl. ..... 53/589; 100/26

(58) Field of Classification Search ..... 53/589; 100/25, 26; *B65B 13/06*
See application file for complete search history.

(56) References Cited

U.S. PATENT DOCUMENTS 3,031,949 A * 5/1962 Daniels et al. ..... 100/26
3,068,782 A * 12/1962 Hasenfratz ..... 100/26
4,043,261 A * 8/1977 Mae ..... 100/26
4,520,720 A * 6/1985 Urban et al. ..... 100/26
5,333,438 A * 8/1994 Gurak et al. ..... 100/26
6,499,525 B1 * 12/2002 Lai ..... 100/26
7,237,478 B1 * 7/2007 Gosis et al. ..... 100/26
2003/0006012 A1 1/2003 Lai

FOREIGN PATENT DOCUMENTS

DE 2507717 A * 9/1976
DE 3814029 11/1988
DE 19912940 A * 9/2000
EP 0596288 5/1994
EP 738658 A * 10/1996
JP 03240618 A * 10/1991
JP 06032308 A * 2/1994
JP 08026207 A * 1/1996
JP 11310203 A * 11/1999

OTHER PUBLICATIONS

International Search Report for PCT/IB2006/003172, mailed Mar. 14, 2007, 2 pages.

* cited by examiner

*Primary Examiner*—Stephen F Gerrity
(74) *Attorney, Agent, or Firm*—Levenfeld Pearlstein, LLC

(57) ABSTRACT

An improved retainer system allowing reliable strapping of a package while incurring only minimized wear. An additional retainer device (17) is placed in front of the inner side of the strap guide frame (11) and comprises an elastic, longitudinally stretching element (18, 19) and a mating support (30). The elastic element and mating support are made of a low-wear material relative to the strap and are mutually parallel, as well as parallel to the strap outlet aperture (23). The elastic element and the mating support together subtend a gap through which the strap is pulled.

12 Claims, 9 Drawing Sheets

DEVICE FOR STRAPPING PACKAGES WITH STRAPPING MATERIAL

BACKGROUND

The present invention relates to package-strapping apparatus, of which the strap in particular is a thermoplastic tape that is fed from a conveyor by means of a cross-sectionally U-shaped strap guide frame to a locking unit, a strap outlet aperture of said frame being at least partly closed by a first strap retainer device in order to preclude premature strap issuance from said frame, said retention device opening when the strap is pulled back to be tensioned around the package and to allow drawing the strap out of its outlet aperture.

Such strapping apparatus are pertinently known already in the state of the art and illustratively include the German patent documents 199 12 940 A1 and 25 07 717 C3 and the European patent document EP 0 738 658 B1.

The strap guide frame of such strapping apparatus typically comprises several legs associated with the said strap retainer device. The state of the art essentially discloses two designs of said retainer devices. In a first design the said retainer device is constituted by several cross-sectionally L-shaped flaps or lids bilaterally configured on at least one guide frame leg. Such lids are displaceably mounted at said guide legs and are approximately as long as the associated legs. In their rest position, they are biased toward said frame by retaining springs and they cover the strap outlet aperture. When the strap is pulled back in order to be tensioned around the package, said lids either are opened in automatic manner or by an external control, and thereby in their open position will impulsively make available the strap segment corresponding to their length.

In a further design of the state of the art, the strapping retainer device is constituted by lip-shaped flexible or plastic elements of defined cross-sectional shape which also are configured bilaterally in the region of the strap outlet aperture and which close said aperture. As described in the German patent document DE 199 12 940 A1, when being pulled back to be tensioned around the package, the strap displaces the zones of said cross-sectionally shaped elements only in its discharge zone, said zone during said process migrating around the strap guide frame.

The strap retainer device meets several purposes. On one hand it is meant to preclude premature and uncontrollable strap issuance from said outlet aperture when the strap is inserted into the said guide frame. As regards vertical strap guide frames, moreover, said retainer device supports the strap inside the guide frame against gravity.

Another significant function of the retainer device is to guide the strap when being pulled out of the strap outlet aperture during pull-back and tensioning around the package. Ideally the strap should be precisely situated within an accurately defined strapping plane on the package. In principle too the lids and the flexible, cross-sectionally shaped strips adequately assure such positioning, however various details are disadvantageous.

As already mentioned above, the said lids always uncover a relatively large portion of the strap outlet aperture, as a result of which strap issues from said zone in uncontrolled manner. When said lids are very long, the strap may come to rest on the package outside the strapping plane, and strapping of the package will be oblique and inadequate to keep said package together. The state of the art furthermore includes a procedure using several short lids, in fact minimizing the above problem, though the strap still may occasionally exit in uncontrollable manner the various zones of its outlet aperture and moreover it tends to twisting whereby it will not always come to rest flat on the package surface. When stacking packages, twisted straps can entail stacking instability. A plurality of small lids also incurs the drawback of requiring substantial maintenance. Each of such small lids is connected by an articulating fastener to said frame and comprises wear-susceptible retaining springs that must be changed frequently. Another drawback is the substantial noise generated by each lid hitting the strap guide frame when said strap outlet aperture is closed again.

The problem of uncontrolled strap pull-out from said strap's aperture does not arise when using the above cited textile lips or plastic, cross-sectionally well defined elements. In fact only the zone from which the strap is being removed will open the cross-sectionally well defined elements resting under tension against the strap applying a force directed in the direction of pulling on said strap and hence allowing removing the strap in controlled manner from the strap outlet apertures. Considering the present-day strap pull-back and pull-out rates occurring when the strap is tensioned around the package, said elastic, cross-sectionally well defined strips wear comparatively fast, again entailing higher costs of maintenance.

SUMMARY

Accordingly it is the objective of the present invention to create an improved package strapping apparatus, in particular an improved retainer device offering reliable package strapping at and wear as low as possible.

This problem is solved by an apparatus in which a second strap retainer device comprising an elastic, longitudinally stretching and a mating support, is placed in front of the side of the strap guide frame which is associated to at least one zone of the strap outlet aperture, the said elastic, longitudinally stretching element and mating support, which are constituted at least in one zone forming a strap contact area, being made of a low-wear material such as a metal and configured parallel to one another and the strapping central aperture, the longitudinally stretching element and the mating support subtending a gap narrower than the central strapping width, the strap, namely at least the elastic, stretching element, being consecutively pulled through said gap, deviating away from the said mating support, when being tensioned around said package.

The apparatus of the present invention assures in advantageous manner that the package shall be strapped reliably within the strapping plane. For that purpose the present invention makes use of two strap retainer devices, a first retainer device reliably closing the strap outlet aperture and the second one assuring pulling the strap in controlled manner out of said strap outlet aperture. Because of the said contact areas of the present invention, the second retainer device will be wear-resistant.

To simplify the manufacture of the elastic, longitudinally stretching element and of the mating support, they may be wholly made of a low-wear material such as a metal, and in particular of steel.

Advantageously the first strap retainer device is constituted by spring-loaded lids movably mounted on said frame, in particular when the lid length of the multi-leg guide frame each time corresponds to the length of the associated guide frame leg. The lids reliably preclude premature strap issuance through the strap guide frame and so to speak incur no wear when compared to flexible cross-sectional defined strips which in principle also may be used in this case.

When the mating support also is designed as an elastic, longitudinally stretching element, this feature does advantageously simplify the design of the second strap retainer device.

When at least one elastic, longitudinally stretching element is associated to a multi-leg strap guide frame, replacement costs due to possible damage can be reduced compared to the design having a single elastic element.

The elastic, longitudinally stretching element may be a simple wire, a rope, a tape or the like. The essential factor is the element's low wear feature. Such standard components allow economically manufacturing the second strap retainer device.

Moreover, in the case of a multi-leg frame, the elastic, longitudinally stretching element should be longitudinally tensioned along the strap guide frame at least along one guide frame leg in order to attain a constant gap while being longitudinally tensioned, as a result of which the strap shall be pulled through said gap against the retaining force exerted by the said tensioned element on said strap.

Advantageously the said elastic, longitudinally stretched element is configured by its end area above a tensioner at the strap guide frame, the tension of said element being regulated by said tensioner. In this manner, even if there were an elongation of said element during operation of the apparatus of the present invention, a constant tension would be assured by readjustment.

When the elastic, longitudinally stretched element is guided in at least one end zone of the strap guide frame using a course-changing means, this feature makes possible on one hand using an endless elastic element running within said strap guide frame. On the other hand such course-changing allows configuring the tensioner on the outside face of the strap guide frame while maintaining a constant gap width between the elastic elements. Moreover other advantageous fasteners of which the shape would preclude their configuration in the gap zone may be used in the present invention.

In an especially preferred embodiment mode of the present invention, the course-changing element is a roller fitted with a circumferential groove guiding the elastic, longitudinally stretched element and comprising a conical zone facing the strap outlet aperture. This circumferential groove assure reliable guidance of the said elastic element on the course changing element. The area of the course-changing means tapering conically toward the strap outlet aperture constitutes a strap slide surface, and consequently the strap is virtually safeguarded against impediments when being pulled out.

If the tensioner and/or the course-changing means are mounted displaceably on the strap guide frame, both elements may be displaced by the strap being pulled through said gap, thereby reducing the danger that said strap might snag in this region.

If the mating support also is designed as an elastic, longitudinal stretching element and is configured above tensioners in at least one end area of the strap guide frame and/or is guided over a course-changing means, then both elastic, stretching elements may be widened by the said strap in gap-enlarging manner.

In a further embodiment mode of the present invention, at least one holder component is configured in displaceable and spring-loaded manner substantially perpendicularly to a strapping plane subtended by the strap guide frame, said holder component comprising at least one leg which is situated in the area of the elastic, longitudinally stretching element and to which is affixed the course-changing means and/or tensioner for at least one elastic, longitudinally stretching element.

This holder component allows advantageously avoiding affixing the course-changing means and/or the tensioner at the guide frame itself, as a result of which strap guidance cannot be hampered by individual guide or affixation components. As already mentioned above, in particular the tensioner may be configured by changing the course of said elastic element outside the gap zone. In this manner constant gap width will be assured. On account of the displaceable holder component, the strap when being pulled out of its guide frame is able to force the tensioner and/or the course-changing means out of their gap-defined path, as a result of which the holder component shall not hamper the strap's retraction or pull-out.

If the holder component is fitted with an adjustment means allowing adjusting a separation between the mating support and the holder component legs, then the gap width defined between the elastic, longitudinally stretching element may be adjusted and the gap of the second retainer device can be matched to various strap widths.

BRIEF DESCRIPTION OF THE DRAWINGS

Further advantages of the package strapping apparatus of the present invention are elucidated in its following description in relation to an illustrative embodiment mode shown in the appended drawings.

DETAILED DESCRIPTION OF EMBODIMENTS

Figure 1:
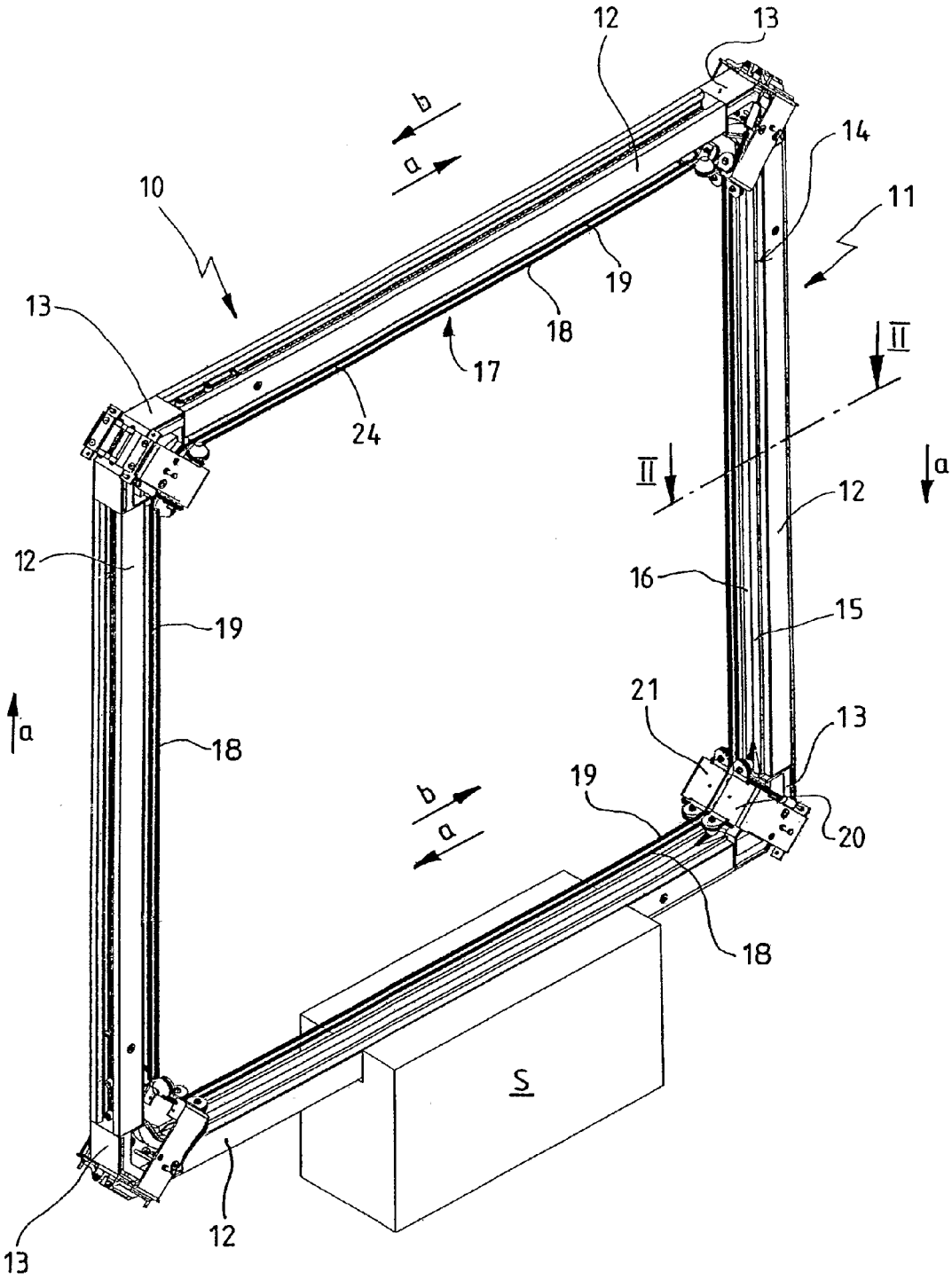
FIG. 1 is a perspective overview of the apparatus of the invention.

FIG. 1 shows a package strapping apparatus denoted overall by the reference 10. Said apparatus shows a strap guide frame 11 mounted on a base S. A number of different and omitted units are housed within the base S, one of said units being a strap locking system. A packing bench supporting the package to be strapped and conventionally transverse to said frame 11 also is omitted.

The strap guide frame 11 is constituted by four frame legs 12 joined to each other by corner parts 13. Said frame furthermore comprises a first retainer device 14 consisting of flaps or lids 15 and 16 and enclosing strap outlet aperture 23 omitted from this Figure but shown in FIG. 2. In this Figure a pair of lids 15, 16 is displaceably supported on each frame leg 12, the lengths of said lids 15 and 16 in each case substantially corresponding to the length of a frame leg 12, as a result of which said lids 15 and 16 completely close the strap outlet aperture 23.

Be it noted in this respect that instead of comprising the shown long lids 15 and 16, a frame leg 12 also may comprise several shorter lids and that in particular the lids 15 and 16—namely as a first retainer device—need not mandatorily be configured in the region of the base S.

A second retainer device 17 is associated with at least one side of the strap guide frame 11, in this instance therefore the inside, of a segment of the strap outlet aperture 23, and said second device here comprises elastic elements in the form of prestressed and hence energetically elastic (non dissipative of energy) wire cables 18 and 19 subtending between them a gap 24. In this instance each pair of wire cables 18 and 19 is respectively associated to a frame leg 12. Accordingly the second retainer device 17 shown in FIG. 1 comprises four pairs of wire cables 18 and 19. Obviously a circumferential pair of wire cables 18 and 19 also may be used as energy-conserving cable elements.

Two holder components 20 and 21 being part of the retainer device 17 are displaceably mounted on each corner part 13. The strap 22 (omitted from FIG. 1) is shot in the direction of the arrow "a" by means of an omitted but well known strap mover at high speed into the strap guide frame 11 until the leading strap end, having completed one lap through said frame, has reached the locking unit. Once there, the end of the strap 22 is held in place and the free length of said strap 22 will be pulled back in the arrow direction "b". In the process, the pairs of lids 15 and 16 open up and uncover the strap outlet aperture 23, as a result of which the tape can be pulled out of the strap guide frame 11 and be pulled farther through the gap 24 subtended between the cables 18 and 19 until the constituted strap loop around the package has been tautened.

Figure 2:
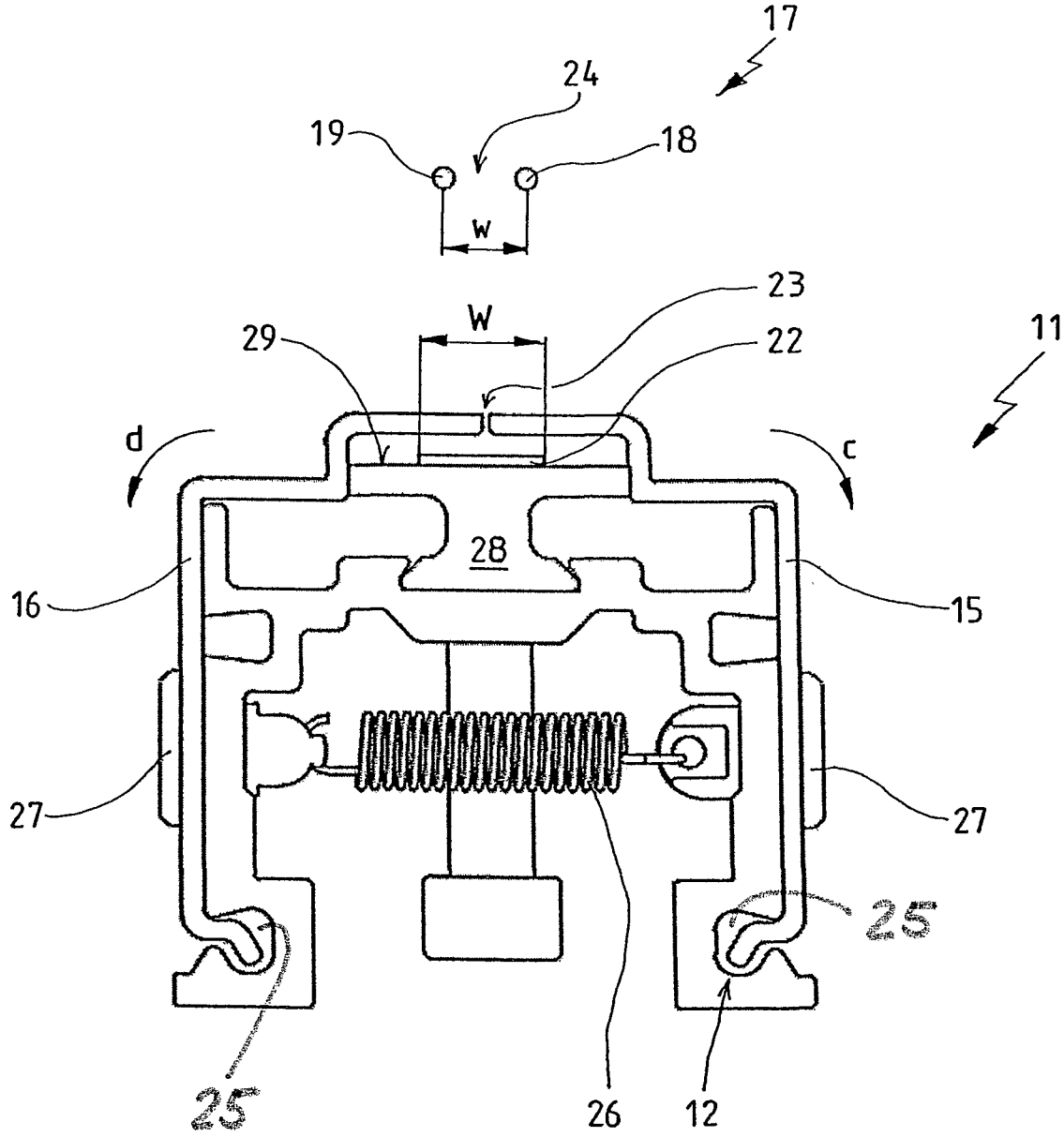
FIG. 2 is a cross-section of the strap guide frame along the sectional line II-II of FIG. 1.

FIG. 2 is a sectional view along line II-II of FIG. 1 of a frame leg 12. The lids 15 and 16 are displaceably suspended from a C-shaped clearance 25 of the frame leg 12 to allow them to tip open in the directions "c" and "d" away from said leg 12. By means of fasteners 27, a helical spring 26 connects the pair of lids 15, 16 to each other and keeps them in a rest position closing the tape (strap) duct 23. A strap guide part 28 is replaceably configured in the strap guide frame 11 and subtends a glide surface 29 on which said strap 22 is inserted without significant friction into the strap guide frame 11. The pair of wire cables 18, 19 is configured a space before the strap outlet aperture 23 and subtends the gap 24 of a width "w" less than the strap width W.

Figure 3:
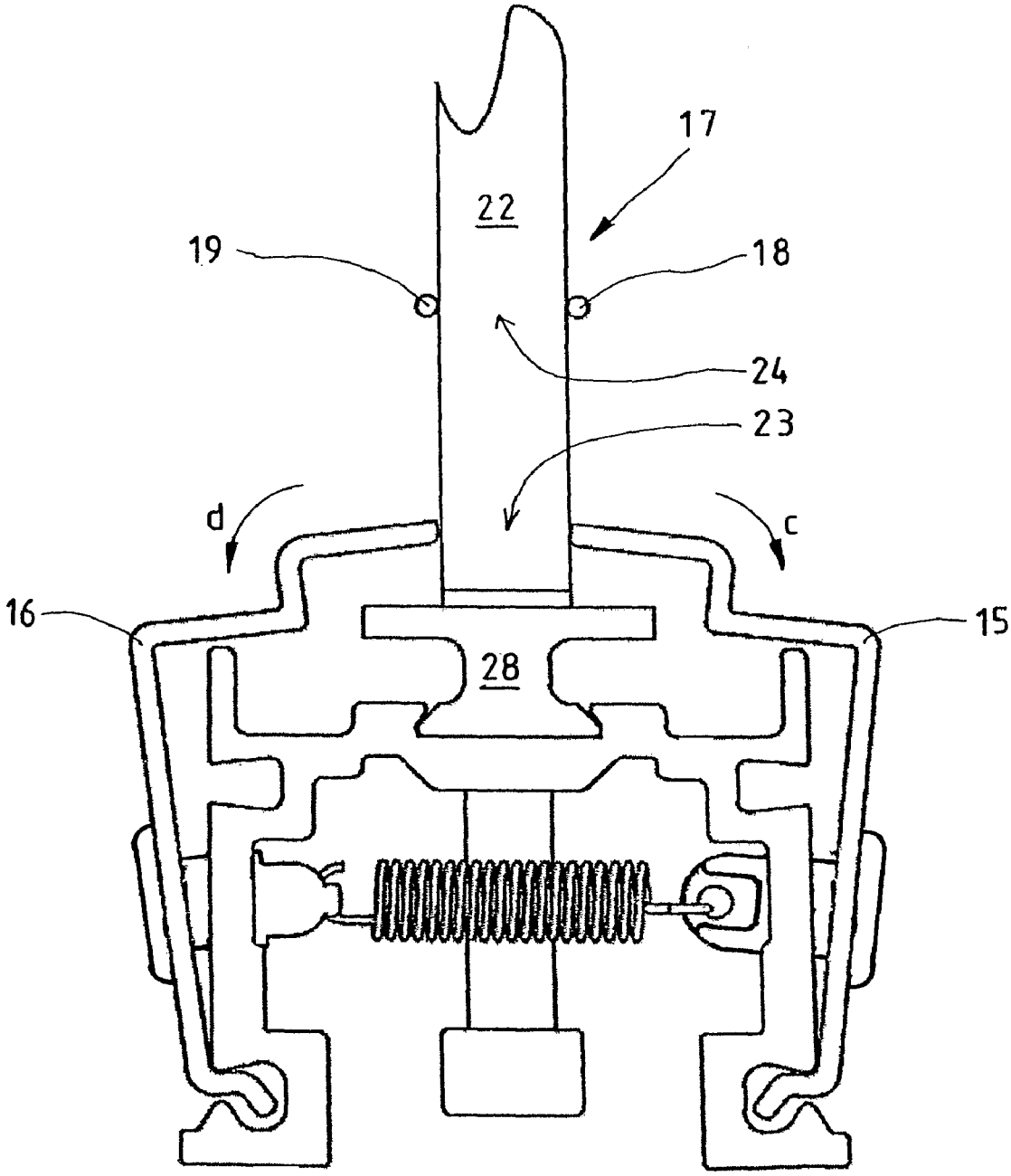
FIG. 3 is a sectional view in the manner of FIG. 2 showing the strap when being pulled back and tensioned.

FIG. 3 is a sectional view corresponding to FIG. 2, the strap 22 in this instance being partly pulled out of the strap guide frame 11 and through the gap 24 of the second retainer device 17. When pulling the strap 22 out of its guide frame 11, the lids 15 and 16 of the first retainer device 14 are opened in the displacement directions "c" and "d" by the strap 22 or by extraneous control and in this manner they uncover the strap outlet aperture 23. Next the strap 22 dips into the gap 24 subtended by the wire cables 18 and 19 of the second retainer device 17 and in this manners said strap expands the gap 24.

Figure 4:
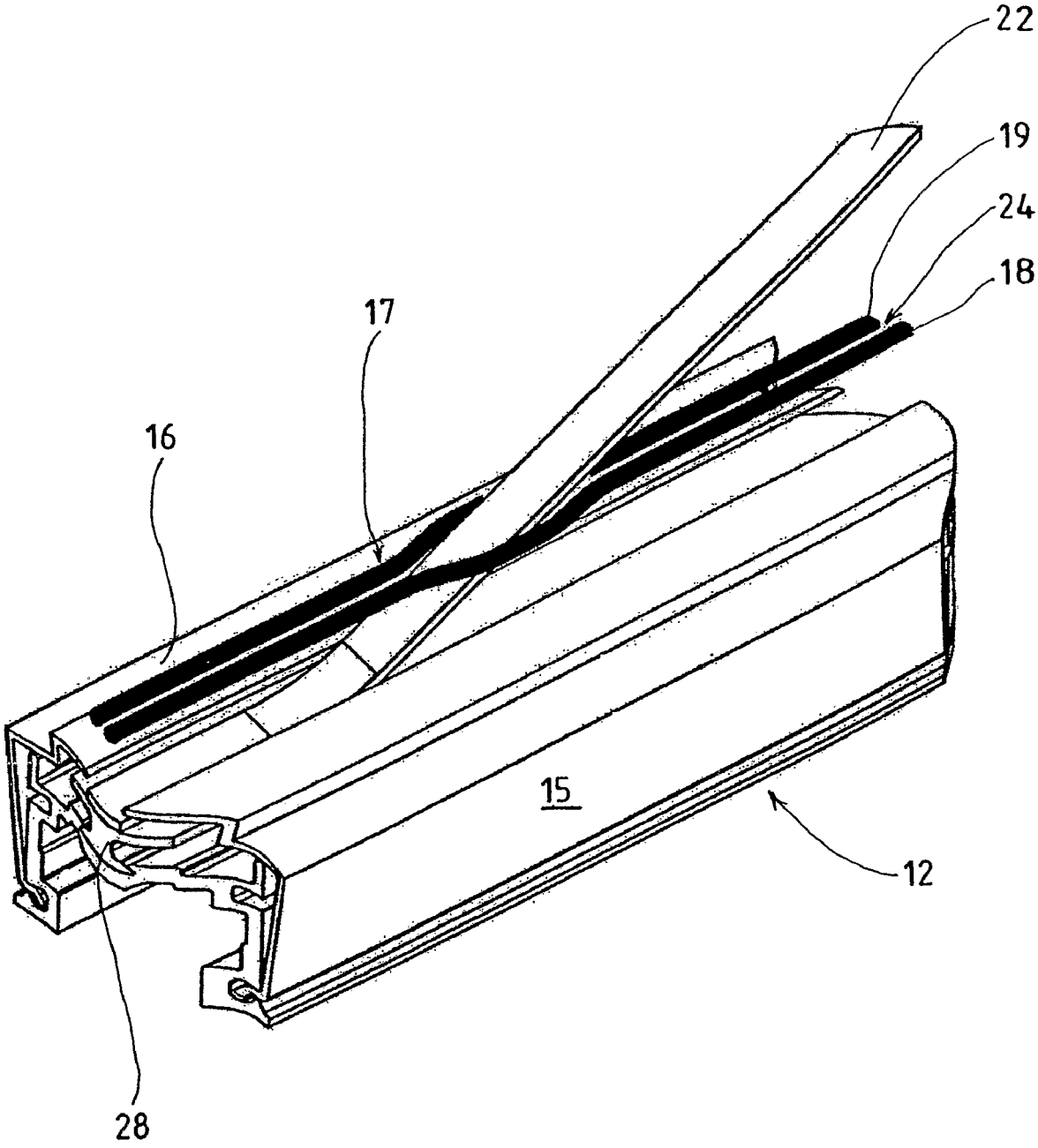
FIG. 4 is a perspective of a portion of the strap guide frame of FIG. 3.

FIG. 4 is a partial, perspective view of a frame leg 12 and shows that the wire cables 18 and 19 will be forced apart only in that zone where the strap 22 is being pulled out at the time. Accordingly the wire cables 18 and 19 are consecutively forced apart by the strap 11 and then will immediately close thereafter. They restore automatically the gap which is less than the strap width W. This process may be construed as being a consecutive peeling of the strap 22 out of the second strap retainer device.

Figure 5:
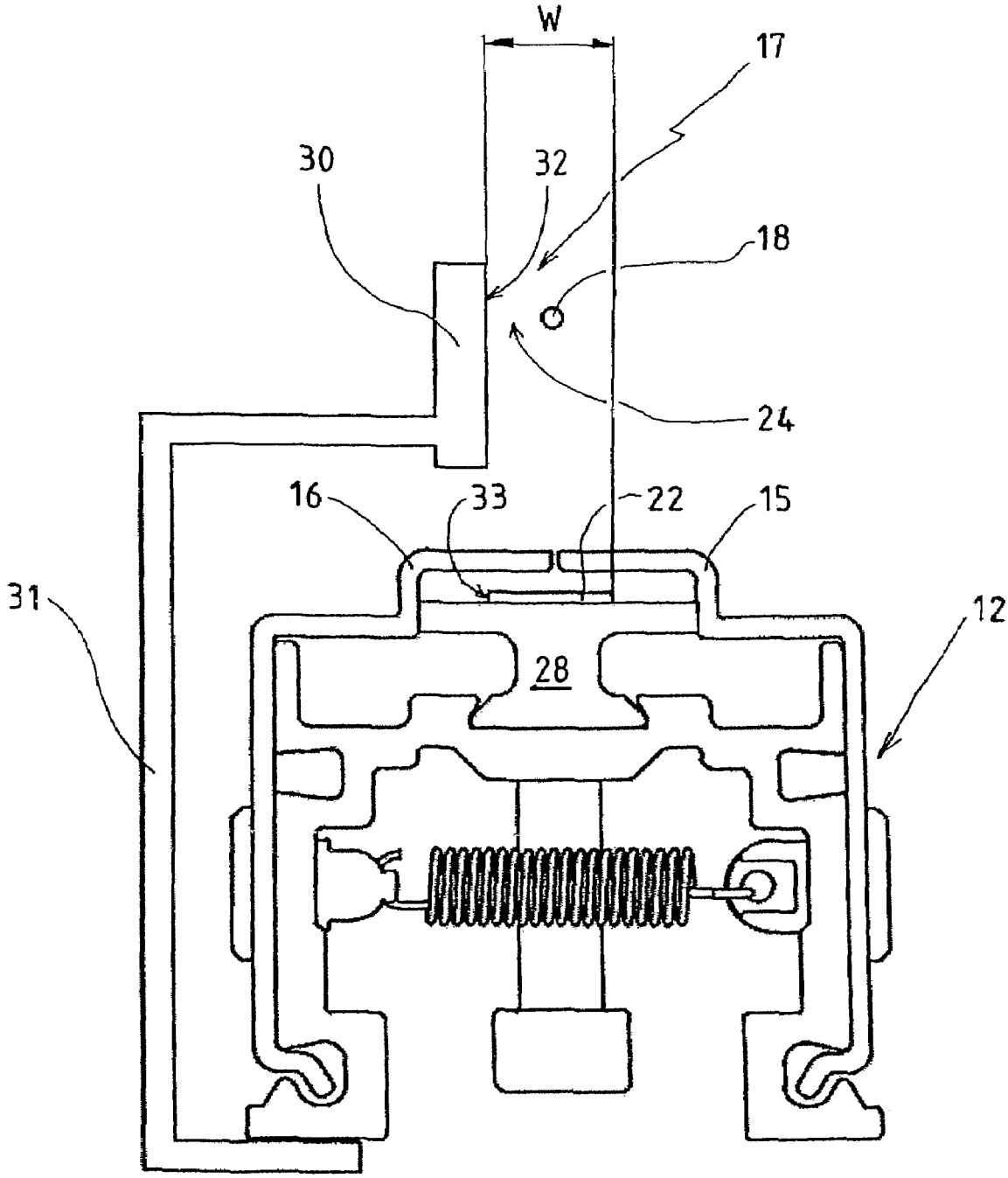
FIG. 5 is a sectional view of the strap guide frame along the sectional line II-II of FIG. 1.

Like FIG. 2, FIG. 5 shows a section of a leg 12 of the strap guide frame 11, the second retainer device 17 in this instance being of a different design.

Instead of the two wire cables 18 and 19 that heretofore combined the mating support and the elastic element into each other, this new design associates a substantially rigid mating support 30 with the wire cable 18. The mating support 30 is mounted by means of a cross-sectionally C-shaped bar 31 to the frame leg 12, whereby its strap guide surface 32 is situated approximately in the area of present left outer edge 33 of FIG. 5 of the strap 22. If the strap guide surface 32 were situated too far in the zone of strap width W, said strap 23 when being pulled through the gap 24 would be undesirably twisted by the mating support 30, possibly entailing defective package strapping.

On the other hand the longitudinally stretched wire cable 18 can be forced away from the mating support and is situated in the zone of the strapping width W, and, as already discussed above and as shown in FIG. 6, is forced apart in gap-widening manner by the strap 22.

Figure 6:
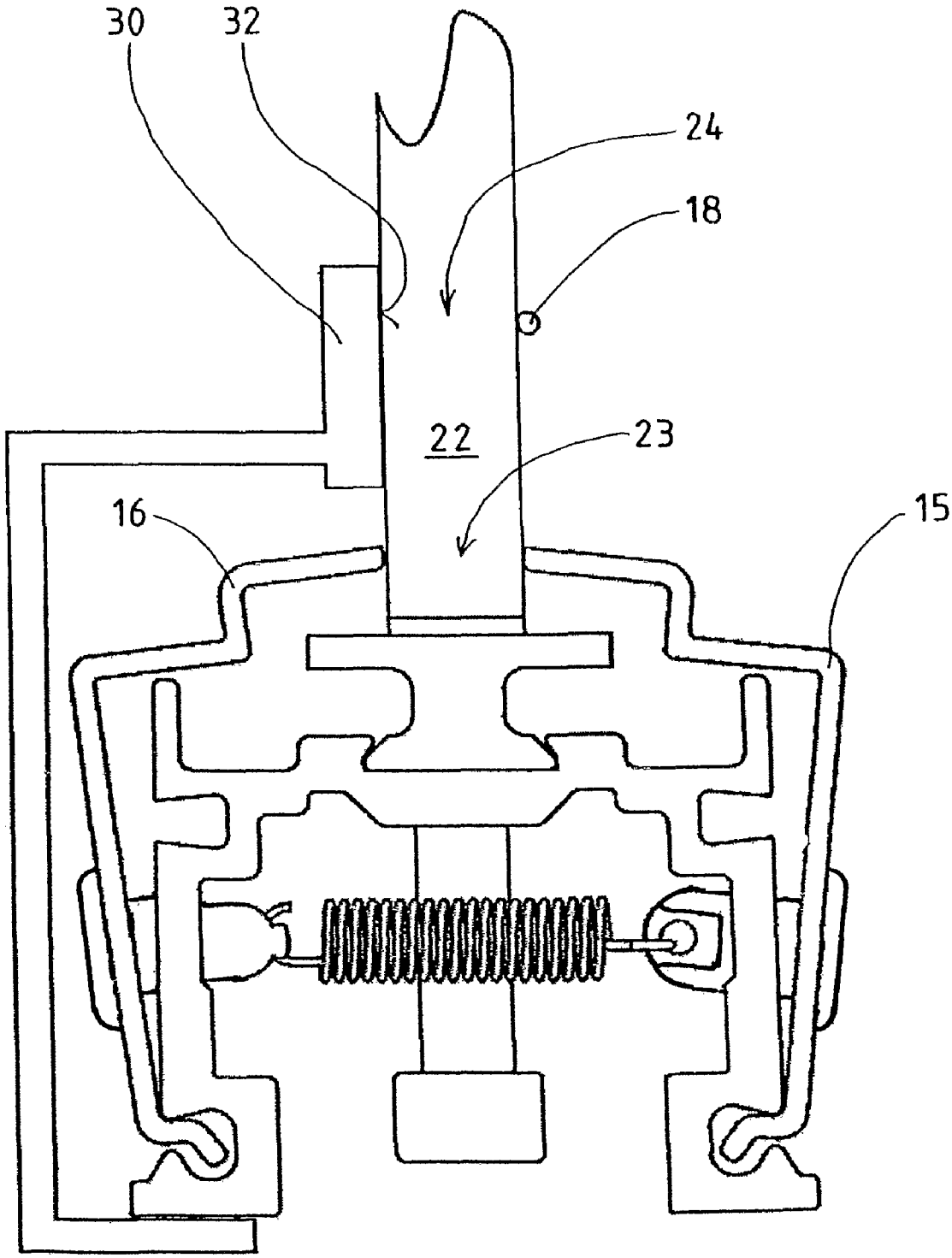
FIG. 6 is a sectional view according to FIG. 5 showing the strap during the pull-back and tensioning procedure.

FIG. 6 is a section corresponding to FIG. 5, and, similarly to the embodiment of FIG. 3, in this instance the strap 22 is pulled out its guide frame 11 and through the gap 24 of the second retainer device 17. The strap 22 again opens the lids 15 and 16 which uncover the strap outlet aperture 23 and it glides along the strap contact surface 32 of the mating support 30, the wire cable 18 in the process being forced in gap-widening manner away from the rigid mating support 30. Said mating support 30 remains in its position in the process.

Figure 7:
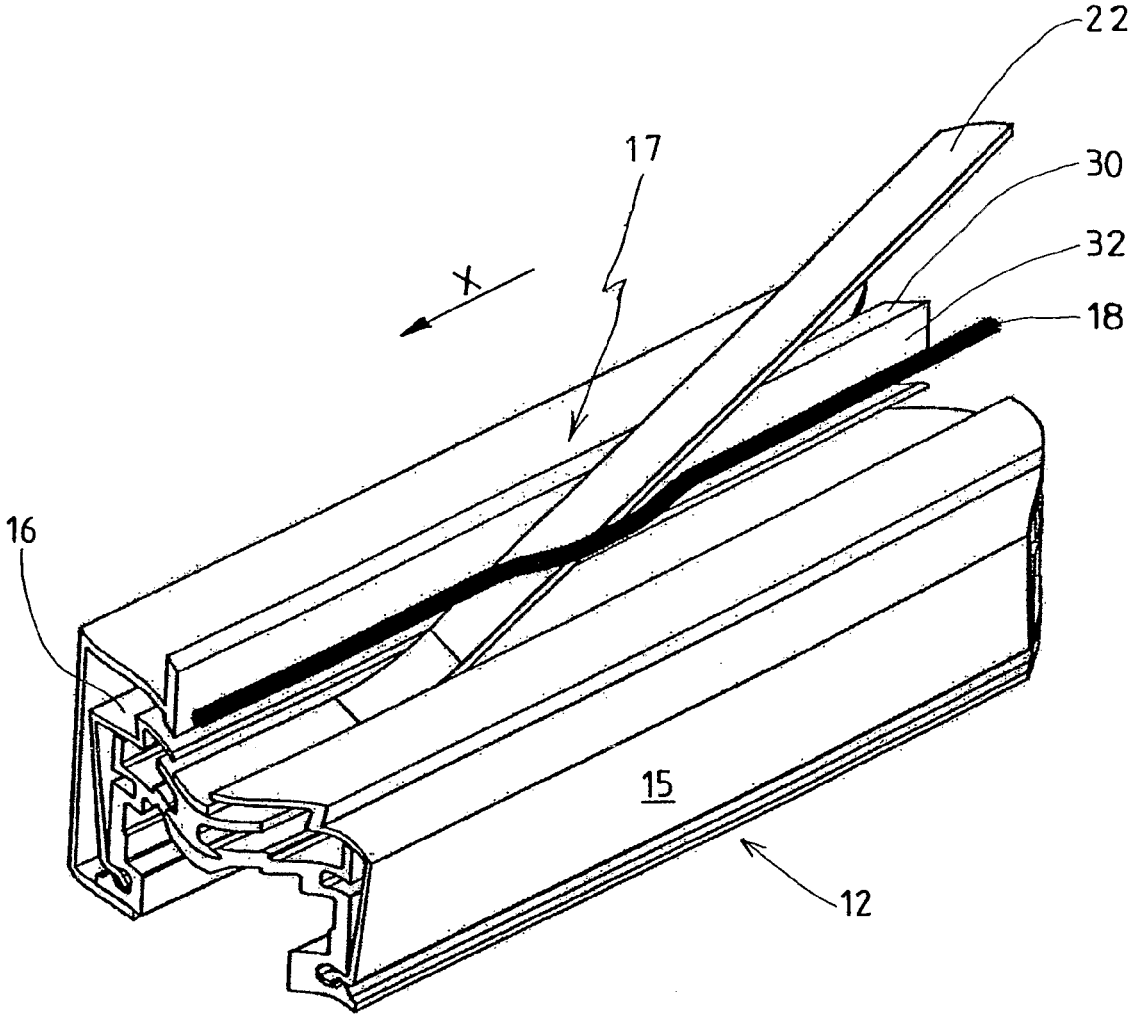
FIG. 7 is a perspective of a portion of the strap guide frame of FIG. 6.

The above described process is also described in FIG. 7 which shows a partial perspective of the frame leg 12. Again it shows that the strap 22 when being pulled through the gap 24 consecutively widens it in the pull-out direction "x", the wire cable 18 resuming its rest position behind the strap 22 (as seen in the x-direction) at a gap 24 less than the strap width W between the mating support 30 the wire cable 18. The wire cable segment 18 is identical with the wire cable segment 19 and in this instance too resets itself free of hysteresis.

Figure 8:
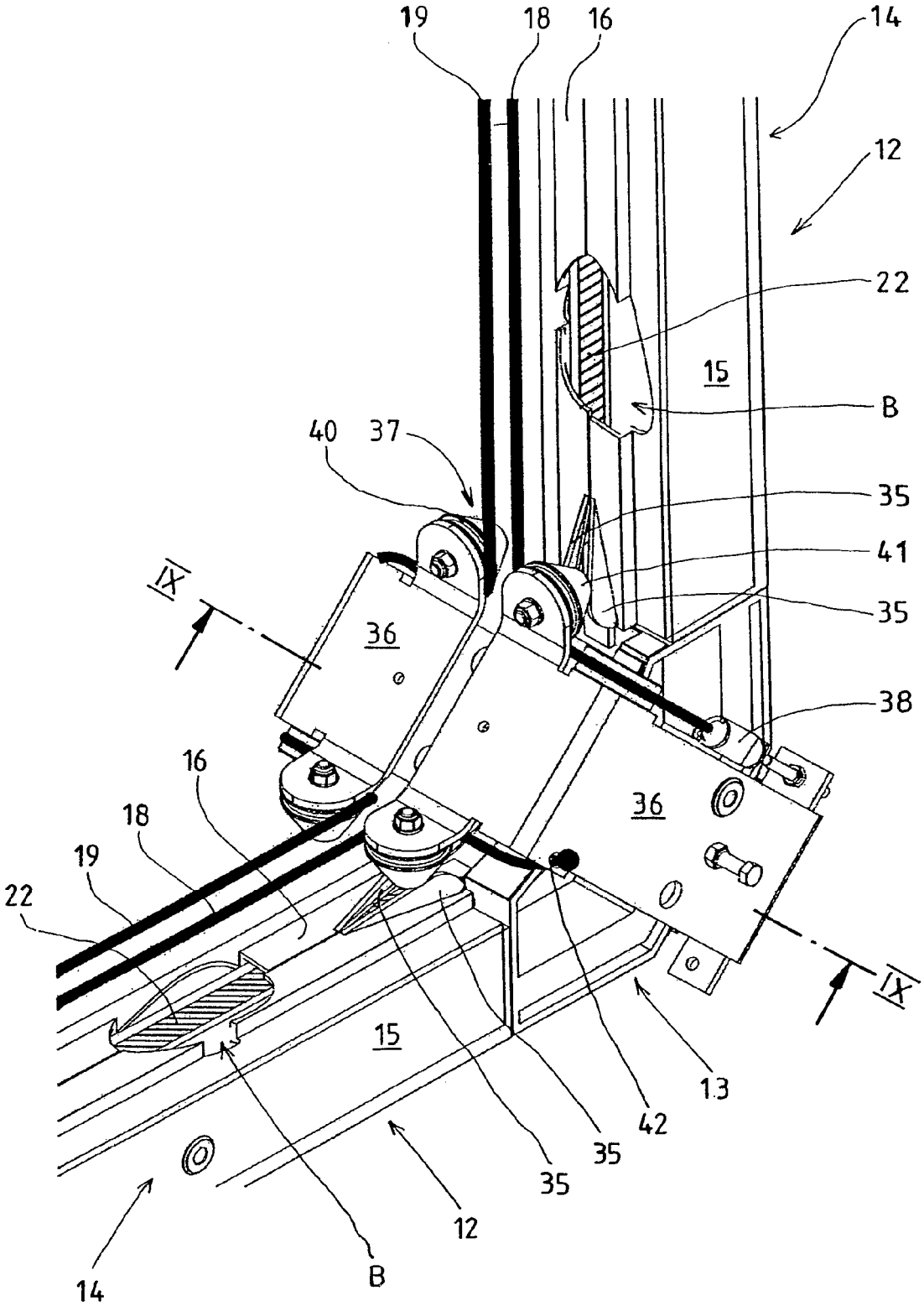
FIG. 8 is a perspective of a strap guide frame zone including the holder component.

FIG. 8 shows a corner zone of the strap guide frame 11. This view shows the first retainer device 14 with its lids 15 and 16 sealing the strap guide frame 11. The view is of the first retainer device 14 with its lids 15 and 16 sealing the strap guide frame 11, said lids being shown in cutaway form in the zones denoted by B. Said zones show a tape-like strap 22 inserted in the strap guide frame 11. Within the corner zones of the strap guide frame 11, the lids 15 and 16 comprise sheetmetal guides 35 which converge conically in a direction away from the corner part 13. Two holder components 36 are present at the corner part itself and receive course-changing means, in this instance rollers 37, further tensioning parts 38 in the form of helical screws which are displaceably mounted by means of hinges 39 to the corner part 13 (also see FIG. 9). The rollers 37 are fitted with a circumferential groove 40 receiving the elastic elements, in this case the wire cables 18 and 19.

The segments of the rollers 37 facing the strap outlet aperture 32 or the frame 4 leg 12 are designed as cones 41. The circumferential surfaces of the cone 41 which tapers toward the strap outlet aperture offer guide, respectively glide, surfaces to the strap 22. In the present embodiment mode, one pair of wire cables 18, 19 is associated with each frame leg 12. Accordingly always one end of the wire cable 18 or 19 is affixed in affixation aperture 42, whereas the other end of said particular wire cable 18 or 19 is affixed by means of a tensioner 38 to the holder component 36.

Figure 9:
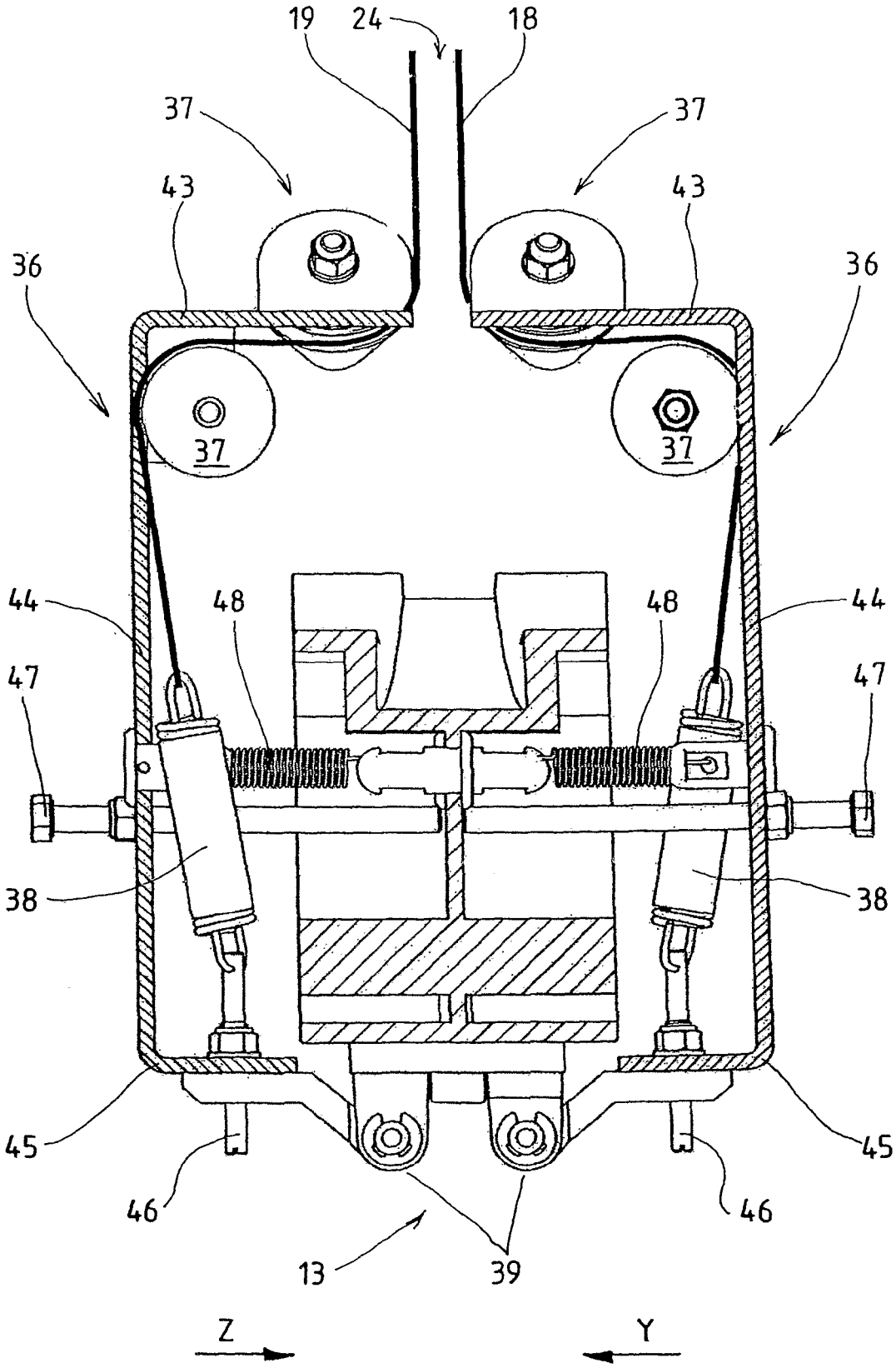
FIG. 9 is a sectional view of the holder component along the sectional line IX-IX of FIG. 8.

The design of the holder components 36 is shown once more in FIG. 9. The holder component 36 consists of the holder component legs 43, 44 and 45, the holder component legs 43, 44 holding the course-changing rollers 37 for the wire cables 18 and 19. The holder component 36 is linked by the holder component leg 45 to the hinges 39 of the corner parts 13 by means of screw bolts 46. These screw bolts 46 anchor the tensioners 38 in the holder component leg 45, the cable tension transmitted from the tensioners 38 to the wire cables 18 and 19 being adjustable by turning said screw bolts in or out. The holder component legs 44 moreover each bear an adjustment component in the form of an adjustment screw 47 resting on the corner part 13. The spacing between the mating support 30 and the holder component leg 43 may be varied by turning in or out the adjustment screws 47. In this manner the gap 24 can be matched by being widened or narrowed to the particular strap 22 being used. Not only variously wide or narrow tape-like straps are applicable, but also string, wires or similar elastic, longitudinally stretchable components. In the embodiment modes shown in FIGS. 1 through 4, 8 and 9, the wire cables 18 and 19 each time constitute the mating support to the other wire cable, as a result of which the gap 24 between the wire cables 18 and 19 is variable each time.

As regards the embodiment mode illustrated in FIGS. 5 through 7, the mating support 30 preferably should be rigidly mounted to the strap guide frame in the absence of a holder component 36. The gap between the rigid mating support 30 and a displaceable holder component 36 associated with one of the elastic elements—in this instance the wire cable 18—could be matched by resetting the adjustment screw 47. In order to keep the holder components 36 in a gap-subtending rest position, said holder components shall be pulled by helical springs 48 in the "y" or "z" directions toward the said strap guide frame.

The interaction between the first and second retainer devices 14 respectively 17, when pulling back the strap 22 and tensioning it around the package is best illustrated and elucidated in relation to FIGS. 1, 3, 4 and 8.

Initially the strap 22 of FIG. 1 is moved in the input shot direction "a" into the strap guide frame 11 and guided along consecutive frame legs 12 to the locking unit housed in the base S. In the process a strap loop of a length corresponding to the frame periphery has been formed. In order to now tension the strap 22 about the omitted package, said strap is pulled back in the direction "b". Being kept in place in the region of the base whereas its length has been shortened, the strap first passes at one end zone through its outlet aperture 23 to exit its guide frame 11. In the process said strap first slides along the on-edge sheetmetal structures 35 of the pairs of lids 15 and 16 to enter the still closed strap outlet aperture 23 and next forces apart said lids respectively in the directions "c" and "d" as shown in FIG. 3. The lids 15 and 16 uncover said outlet aperture 23 over the entire length of a guide frame leg 12.

Thereupon the strap 22 glides along the circumferential surface of the cones 41 of the course-changing rollers 37 and in this manner it forces apart the holder components 36 against the force of the helical spring 48 until the gap in this zone corresponds to the strap width. This process takes place at every corner zone.

By further retracting the strap 22, the strap loop length is further reduced and the strap is pulled through the gap 24. In the process said strap exits the region of the holder components 36 shown in FIG. 8 and follows the gap 24, henceforth acting as a guiding gap in the strapping plane, constituted by the wire cables 18 and 19. In the process the strap 22 in its outlet zone consecutively widens the gap 24 that shall close again beyond said strap's rear. The pressure laterally applied by the wire cable tension against the strap 22 entails frictional impedance against pull-back, as a result of which the strap 22 shall be tensioned between two points of the second retainer device 17 during the entire pull-back procedure. The strap 22 is guided in this manner in the strapping plane subtended by its guide frame 11 and is snugly applied against the package.

In summary, the present invention is characterized by the following advantages. By using two strap retainer devices, each of these devices can be designed optimally with respect to its function. Lids of which the lengths approximately correspond to the lengths of the associated guide frame legs have been found appropriate in the state of the art for application to an uncontrolled strap outlet during the input shot intake implemented from the strap guide duct. The elastic, longitudinally stretching elements are preferably energy conserving (non-dissipating) cables which can consist entirely of metal. In the process the sharp (tape) edge of said strap comes into contact only with a minute contact surface of said elastic element, whereby, besides using a low-wear material, wear is reduced further.

Moreover the second strap retainer device substantially assumes the function of stabilizing said tape when latter is ejected in order to attain snug strap apposition to the package within the strapping plane.

A second strap retainer device constituted by two longitudinally stretching energy-conserving elements will not require special width-matching when changing straps because following gap spreading said elements reset themselves automatically in hysteresis free manner whereby constant gap width is maintained.

The invention claimed is:

1. A package-strapping apparatus for positioning a plastic strap around a load, comprising:

a cross-sectionally U-shaped strap guide frame enclosing the package, the guide frame having a strap outlet aperture being at least partly covered by a first strap retainer device to preclude uncontrolled issuing of strap from the guide frame, the strap retainer device opening when strap is retracted to tension the strap around the package and allowing pulling the strap out of the outlet aperture, the guide frame including a second strap retainer device having an elastic, longitudinally stretching element and a mating support positioned in front of at least one segment of a side of the strap guide frame associated with the strap outlet aperture, wherein the elastic, longitudinally stretching element and the mating support are formed from a low-wear material in a zone constituting a contact surface with the strap and are configured mutually parallel and parallel with respect to the strap outlet aperture, the elastic, longitudinally stretching element and the mating support subtending a gap therebetween that is smaller than a width of the strap, the strap being pulled through the smaller gap when being tensioned around the package while forcing the elastic, longitudinally stretching element away from the mating support.

2. The package-strapping apparatus in accordance with claim 1, wherein the elastic, longitudinally stretching element is formed from a low-wear metal.

3. The package-strapping apparatus in accordance with claim 2 wherein the low-wear metal is steel.

4. The package-strapping apparatus in accordance with claim 1, wherein the first strap retainer device includes spring-loaded lids displaceable from the guide frame.

5. The package-strapping apparatus in accordance with claim 4, wherein the strap guide frame includes several legs, and wherein the spring-loaded lids have a length, and wherein the length of the lids corresponds to about the length of an associated guide frame leg of the strap guide frame.

6. The package-strapping apparatus in accordance with claim 1 wherein the mating support is an elastic element.

7. The package-strapping apparatus in accordance with claim 1 wherein at least one elastic element is associated with each leg of a multi-leg strap guide frame.

8. The package-strapping apparatus in accordance with claim 1 wherein the elastic element is a wire, rope, cable or tape.

9. The package-strapping apparatus in accordance with claim 1 wherein the elastic element is longitudinally tensioned along the strap guide frame having multiple legs along at least along one guide frame leg to define a constant gap.

10. The package-strapping apparatus in accordance with claim 9 wherein the tension in the elastic element is regulated by a tensioner.

11. The package-strapping apparatus in accordance with claim 1 wherein the elastic element is kept in a longitudinally stretched state by a tensioner mounted on the strap guide frame.

12. The package-strapping apparatus in accordance with claim 11 wherein the tension in the elastic element is regulated by the tensioner.

* * * * *